US005547292A

United States Patent [19]

Harada

[11] Patent Number: 5,547,292

[45] Date of Patent: Aug. 20, 1996

[54] PRINTING APPARATUS

[75] Inventor: Hiroyuki Harada, Tokyo, Japan

[73] Assignee: Seikosha Co., Ltd., Tokyo, Japan

[21] Appl. No.: 374,440

[22] Filed: Jan. 19, 1995

[30] Foreign Application Priority Data

Jan. 28, 1994 [JP] Japan ..... 6-008453

[51] Int. Cl.$^6$ ..... B41J 11/20

[52] U.S. Cl. ..... 400/58; 400/55

[58] Field of Search ..... 400/58, 55, 56, 400/57, 59, 60

[56] References Cited

U.S. PATENT DOCUMENTS

| | | | |
|---|---|---|---|
| 5,136,937 | 8/1992 | Nogawa | 400/58 |

FOREIGN PATENT DOCUMENTS

| | | | |
|---|---|---|---|
| 0371718 | 6/1990 | European Pat. Off. | 400/55 |
| 56-77177 | 6/1981 | Japan | 400/56 |
| 58-96581 | 6/1983 | Japan | 400/58 |
| 203072 | 11/1983 | Japan | 400/58 |
| 0191165 | 8/1987 | Japan | 400/55 |
| 0176855 | 8/1987 | Japan | 400/55 |
| 2258380 | 10/1990 | Japan | 400/56 |

*Primary Examiner*—Ren Yan
*Attorney, Agent, or Firm*—Amster, Rothstein & Ebenstein

[57] ABSTRACT

To provide a printing apparatus in which a mechanical portion that is heavy in weight and needs a high precision is fixed to simplify a structure and to perform a high speed operation with a high quality printing. A piece of printing paper P is guided between a printing head 1 and a platen 2 for printing. A pair of stationary frame plate 20 are mounted to face each other on a base frame for supporting the printing head, and a platen driving unit 3 for contacting the platen 2 against the printing head 1 and separating the platen 2 away from the printing head 1 is mounted on the base frame. A guide shaft 4 for guiding a carrier 7, that carries thereon the printing head, in a printing direction, a carrier the 5 for driving the carrier in the printing direction, and stoppers 6 that face the platen around the printing head with their ends protruding toward the platen beyond a front surface of the printing head are fixed to the stationary frame plates 20. The platen driving unit 3 keeps, in a printing stand-by mode, a gap between the platen and the printing head 1 to a predetermined gap that is larger than that in a printing operation by depressing the platen by a cam 22, and in the printing operation, clamp and fasten the printing paper between the platen and the stoppers by raising the platen with the biasing force of a compression spring 21.

3 Claims, 5 Drawing Sheets

FIG. 5(a)
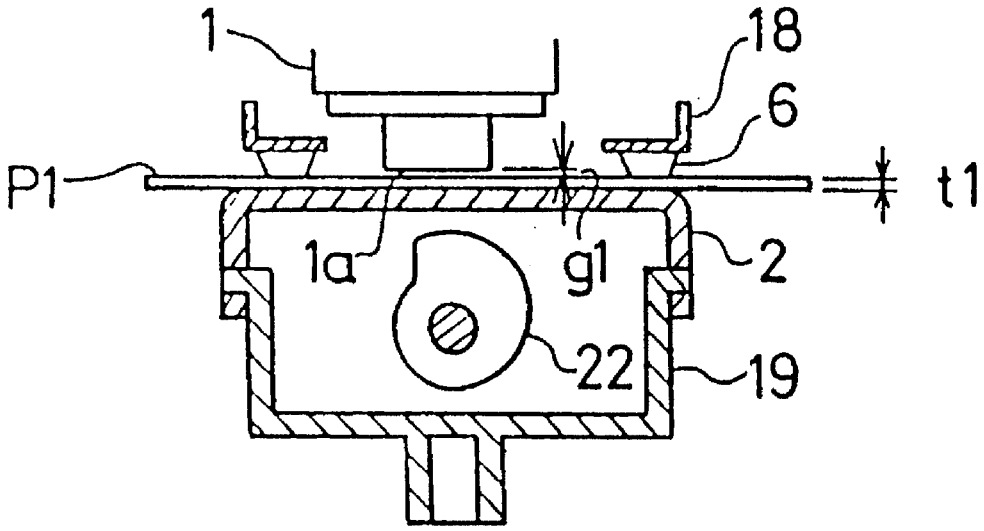
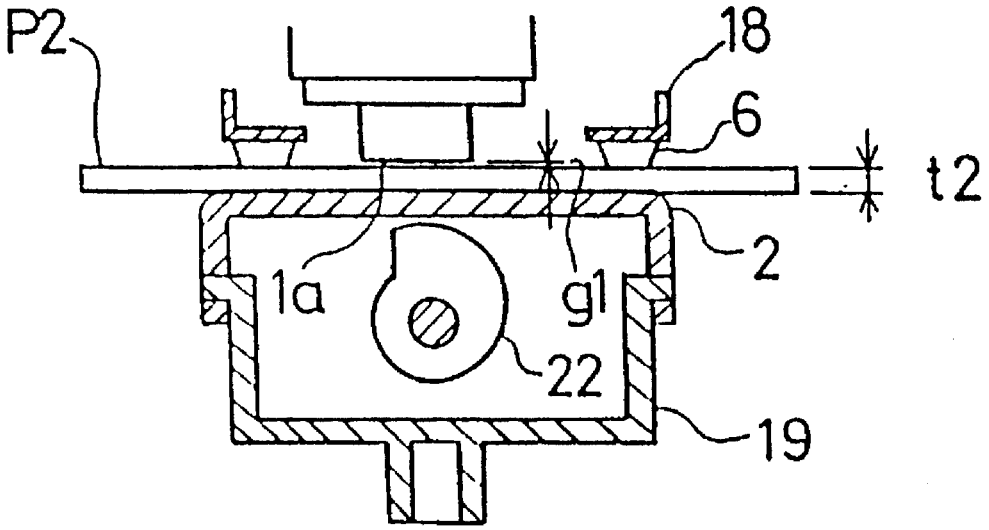
FIG. 5(b)

PRINTING APPARATUS

BACKGROUND OF THE INVENTION

1. Field of the Industrial Application

The present invention relates to a compact printing apparatus such as a time recorder and a time stamper, and more particularly to a printing apparatus for printing information on pieces of printing paper having various thicknesses, which paper is manually inserted into the apparatus.

2. Prior Art

For instance, as one of such printing apparatus, there is provided a serial type printing apparatus. In order to obtain a high quality print, during the printing operation, it is necessary to keep a gap between a printing head and a printing surface of paper at a level 1 mm or less. Also, it is necessary to keep the gap constant even for pieces of paper having various thicknesses.

In view of the fact that the sheet such as a time card or the like is manually inserted, it is important that the insertion of the printing paper is easy and the sheet is fixed so as not to be displaced in position.

To meet this requirement, as shown in, for example, Japanese Patent Application Laid-Open No. Hei 4-50253, a frame plate on which is mounted a mechanical portion including a printing head, a guide shaft and the like is mounted to be movable relative to a base frame in a direction of the thickness of the printing paper, a spring is provided for always drawing the frame plate toward the base frame, and a cam disc is provided on a cam shaft for moving the printing head in the printing direction, for moving the frame plate upwardly against the drawing force of the spring to thereby expand the passage, into which the printing paper is to be inserted when the printing head is moved toward the printing start position and for moving the frame plate downwardly toward the base frame by releasing the force for moving the flame plate upwardly during the printing operation. Also, a rubber stopper is provided on the frame plate so that the gap between the printing head and the printing paper surface is kept constant and the printing paper is retained in place.

In such a conventional apparatus, since the printing mechanical portion including the printing head as a whole is moved, a structure for moving the printing mechanical portion as a whole is complicated, and its assembling property is degraded. Also, since the portion which moves is heavy in weight, it is difficult to increase the speed of the operation and a motor having a high output power for moving the portion is needed. Furthermore, since the high precision mechanical portion including the printing head is moved, the manufacture cost is increased and the printing quality is degraded.

In view of these defects inherent to the conventional apparatus, an object of the present invention is to provide a printing apparatus in which a mechanical portion that is heavy in weight and needs a high precision is simplified in structure, thereby increasing the printing operation and ensuring a stable printing quality in low cost.

SUMMARY OF THE INVENTION

In order to attain this object, according to the present invention, there is provided a printing apparatus for guiding a piece of printing paper between a printing head and a platen and effecting the printing, wherein: a pair of stationary frame plates are mounted to face each other on a base frame for supporting the printing head and at the same time, a platen driving means for contacting the platen with the printing head and moving the platen away from the printing head is mounted on the base frame; a guide shaft for guiding a carrier, that carries thereon the printing head, in a printing direction, a carrier driving means for driving the carrier in the printing direction, and stoppers that face the platen around the printing head with their ends protruding toward the platen beyond a front surface of the printing head are fixed to the stationary frame plates; and the platen driving means keeps, in a printing stand-by mode, a gap between the platen and the printing head to a predetermined gap that is larger than that in a printing operation and clamps and fastens the piece of printing paper between the platen and the stopper in the printing operation.

The platen driving means includes a biasing means for biasing the platen in a direction close to the printing head, and a platen moving means for moving the platen away from the printing head against a biasing force of the biasing means; in the printing stand-by mode, the platen moving means keeps the gap between the platen and the printing head to the predetermined gap which is larger than the gap in the printing operation; and in the printing operation, the printing paper is clamped and fastened between the platen and the stoppers by the biasing force of the biasing means.

The platen moving means may be a cam which is rotated by a driving torque of the carrier driving means.

A guide surface for the printing paper is provided on the base frame, and the platen driving means causes, in the printing stand-by mode, the platen to be flush with the guide surface or to be shifted to a position away from the printing head beyond the guide surface.

BRIEF DESCRIPTION OF THE DRAWINGS

FIGS. 5(*a*) and 5(*b*) are cross-sectional views showing conditions where pieces of thin and thick paper are used for printing.

DETAILED DESCRIPTION OF THE PREFERRED EMBODIMENTS

Figure 1:
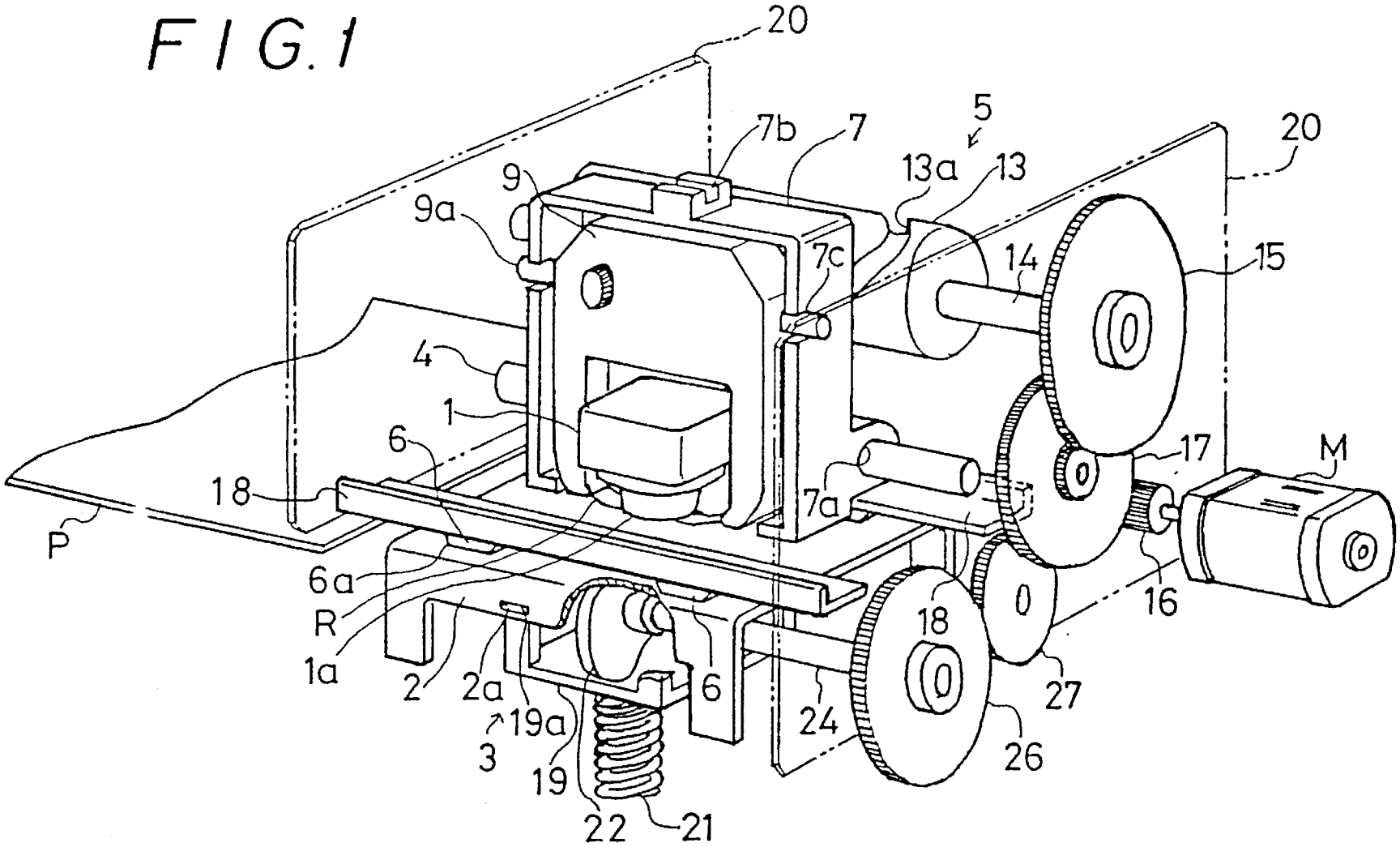
FIG. 1 is a perspective view showing a structure of a primary part according to one embodiment of the invention.

One embodiment of the invention will now be described with reference to FIGS. 1 and 2.

In the printing apparatus according to the present invention, a piece of printing paper P is guided in between a printing head 1 and a platen 2 for printing. A pair of stationary frame plates 20 are mounted on a base frame 10 for supporting the printing head so as to face each other at a predetermined interval, and a platen driving means 3 is mounted on the base frame 10 for contacting the platen 2 against the printing head 1 and separating the platen 2 away from the printing head 1.

A guide shaft 4, a carrier driving means 5 and stoppers 6 are mounted on the stationary frame plates 20.

Figure 2:
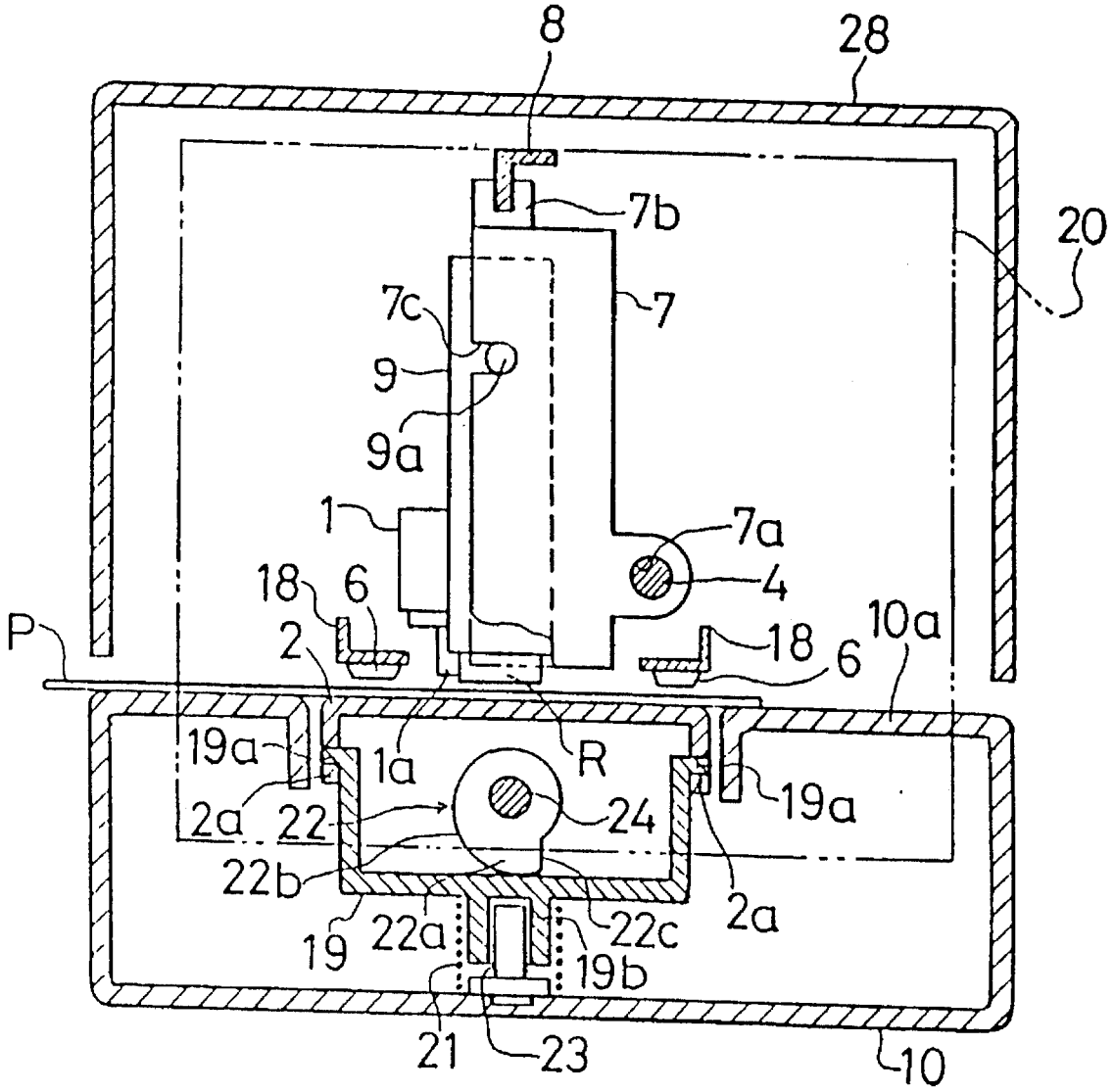
FIG. 2 is a central cross-sectional view showing the primary part.

The guide shaft 4 is used to guide the carrier 7, which carries thereon the printing head 1, in a printing direction (in the left and right direction in FIG. 1, i.e., a direction perpendicular to the paper surface of FIG. 2). The guide shaft 4 penetrates bearing portions 7*a* provided on the carrier 7, and an engaging portion 7*b* formed on the top surface of the carrier 7 slidingly moves along a guide plate 8 fixed to a ceiling plate of the stationary frame plates 20 so that the printing head 1 is guided in the printing direction always with its correct posture. A ribbon cassette 9 is loaded on the carrier 7 by engaging protrusions 9*a*, each of which protrudes from the ribbon cassette side, with recess portions 7*c* on the carrier side. An ink ribbon R drawn from the ribbon cassette is adapted to pass through a space defined between a front surface 1*a* of the printing head 1 and the platen 2.

There is shown a cylindrical cam 13 which is the carrier driving means 5 for moving the carrier 7 in the printing direction. The cylindrical cam 13 is pivotally mounted on the stationary frames 20 by a shaft 14 and is provided around its outer circumferential portion thereof with a spiral groove 13A. A cam follower (not shown) which extends from the carrier is engaged with the groove 13*a* so that a reciprocating motion defined by the groove is effected by the rotation of the cylindrical cam 13. In order to drivingly rotate the cylindrical cam 13, a transmission gear 15 is fixed to a protrusion end of the shaft 14 from the stationary frame 20 so that the rotation of a driving gear 16 of a motor M is transmitted thereto through a reduction gear 17.

The stoppers 6 face the platen 2 around the front surface of the printing head 1 so that ends 6*a* of the stoppers 6 are projected beyond the front surface 1*a* of the printing head 1 toward the platen. A pair of beams 18 are mounted on the stationary frames 20 for fixing the stoppers at predetermined positions. Two pairs of stoppers 6 are fixed to predetermined positions on bottom surfaces of the beams 18, respectively. It is preferable that the stoppers 6 are made of elastic material having a high frictional coefficient for dampening the shock caused when the platen is raised and for retaining the paper P.

The ends 6*a* of the plurality of stoppers 6 provided around the printing head 1 are flush with each other and arranged in parallel with the front surface 1*a* of the printing head 1. The gap g1 (see FIG. 4(*b*) between the end face of each stopper and the front surface of the printing head 1 is set to be identical with the gap between the printing surface of the printing paper P and the printing head 1 during the printing operation where the best printing quality is maintained in response to the performance of the printing head 1.

The platen 2 provided to face the printing head 1 is received by a platen receiver 19. Engaging pawls 19*a* provided on top end portions of legs extending upwardly from the surface of the platen receiver 19 are engaged with the engaging holes 2*a* provided on the platen 2 to thereby engage the two components with each other.

The platen driving means 3 includes a compression spring 21 used as a biasing means for biasing the platen 2 in a direction close to the printing head 1 and a cam 22 used as a platen moving means for separating the platen 2 away from the printing head 1 against the biasing force of the compression spring 21.

In connection with the compression spring 21, a cylindrical guide member 23 is fixed to an inner bottom surface of the base frame 10, a slidable portion 19*b* is formed vertically on a lower surface of the platen receiver 19, and a protrusion of the guide member 23 is loosely engaged with a hollow portion of the slidable portion 19*b*. The compression spring 21 is interposed under the compression condition around the slidable portion 19*b* between the inner bottom surface of the base frame 10 and the lower surface of the platen receiver 19, thereby imparting the biasing force to the platen receiver 19 upwardly.

Also, the cam 22 is fixed to the cam shaft 24 with such a shape that a cam portion 22*a* and a bottom portion 22*b* are connected with each other by a falling edge portion 22*c*. The cam shaft 24 is rotatably connected at one end with a support plate 25 provided vertically on the base plate 10 (see FIG. 3(*a*)) and at the other end with the stationary frame plate 20. The drive torque from the motor M which is commonly used for driving the carrier driving means 5 is transmitted through a transmission gear 27 to a gear 26 fixed to a protrusion end from the stationary frame plate 20. Namely, the cam 22 is drivingly rotated in synchronism with the cylindrical cam 13. In the embodiment, when the cam 22 is rotated through one turn, the cylindrical cam 13 is also rotated through one turn.

The cam 22 is positioned on the top surface side of the platen receiver 19. In the printing stand-by mode, when the cam shaft 24 is rotated by the drive torque of the motor M, the cam portion of the cam 22 depresses the platen receiver 19 downwardly against the biasing force of the compression spring 21 to keep the gap between the printing head 1 and the platen 2 to a predetermined gap g2 which is larger than that in the printing operation (see FIG. 3(*b*)). In the printing operation, the pressure of the compression spring 21 by the cam 22 is released, and the platen 2 is raised by the biasing force of the compression spring 21 so that the printing paper is clamped and fixed between the platen 2 and the stoppers 6. In the printing operation, the gap between the printing head 1 and the printing surface of the printing paper P is identical with the gap g1 between the front faces of the stoppers 6 and the front surface 1*a* of the printing head 1.

Figure 3B:
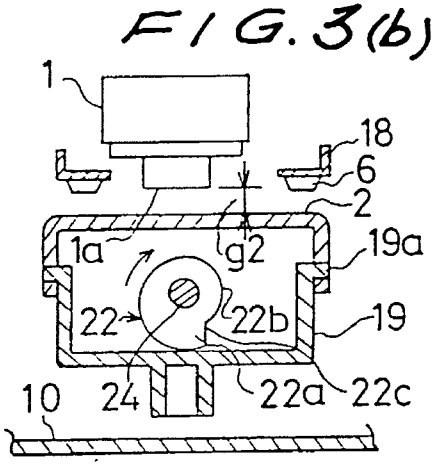
FIGS. 3(*a*) and 3(*b*) are cross-sectional views showing the primary part in a printing stand-by mode.
Figure 3A:
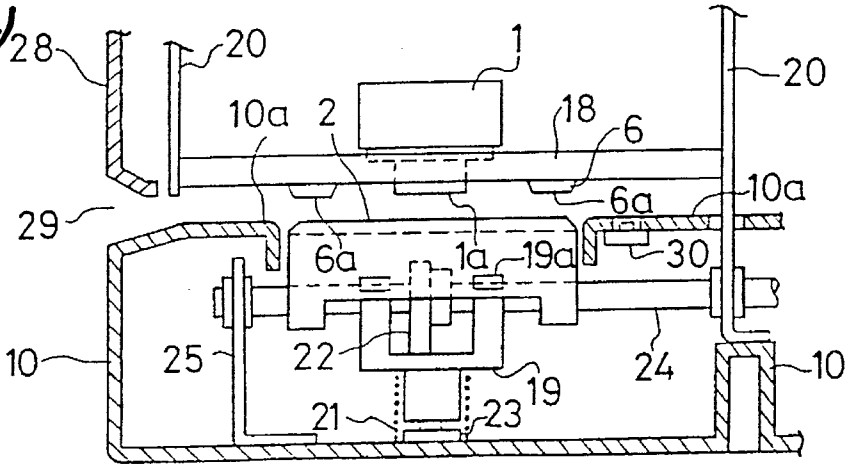

As shown in FIG. 3(*a*), a paper supply slot 29 for the printing paper P is provided between a cover 28 for covering the printing head 1 and the like and the base frame 10. The top surface of the base frame inside the paper supply slot 29 is used as a paper guide surface for introducing the printing paper P between the front surface 1*a* of the printing head 1 and the platen 2. In the printing stand-by mode where the cam portion 22*a* of the cam 22 causes the platen receiver 19 to move downwardly against the compression spring 21 to hold the platen 2 at the descending position, the platen driving means 3 causes the platen 2 to be flush with the paper guide surface 10*a* or to be shifted to the position away from the printing head 1 beyond the guide surface 10*a*.

A sensor 30 is disposed at a rear side of the guide surface 10*a* relative to the paper supply slot 29 beyond the platen 2 for detecting the printable condition in which the paper P is inserted for printing. The sensor 30 may be a reflector type photosensor or the like.

The operation of the platen driving means 3 will now be described in detail with reference to FIGS. 3(*a*), 3(*b*), 4(*a*) and 4(*b*). FIGS. 3(*a*) and 3(*b*) show a position of the platen 2 in the printing stand-by mode. The cam shaft 24 is drivingly rotated by the driving torque of the motor M. The cam 22 is rotated so that the cam portion 22*a* causes the platen receiver 19 to move downwardly against the biasing force of the compression spring 21. As a result, the platen 2 is kept away from the front surface 1*a* of the printing head 1 and the gap g2 that is larger than that in the printing operation is kept.

Figure 4B:
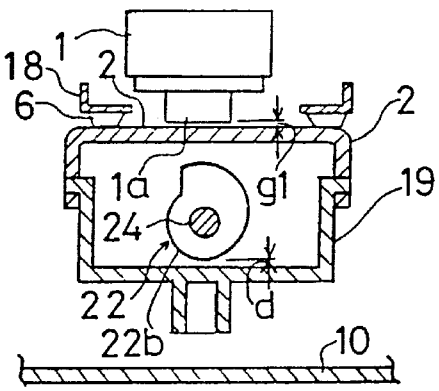
FIGS. 4(*b*) and 4(*b*) are cross-sectional views showing the primary part in a printing operation.
Figure 4A:
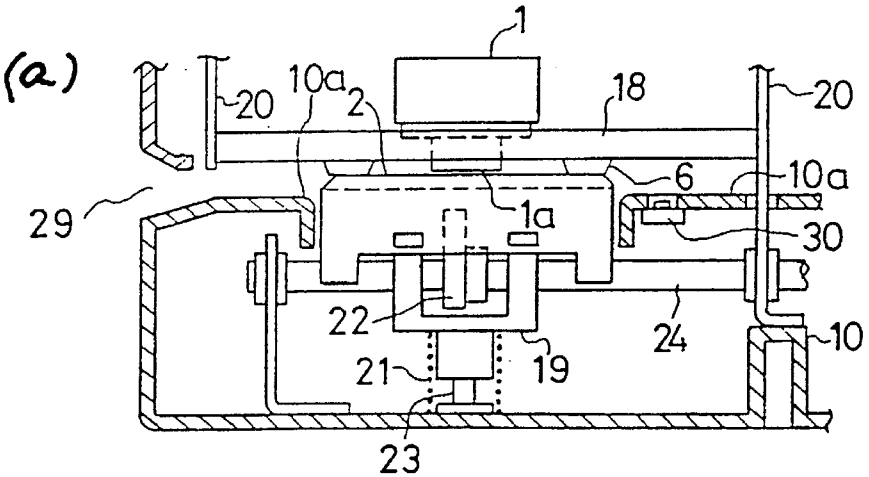

FIGS. 4(*a*) and 4(*b*) show a position of the platen 2 in the printing operation. The cam shaft 24 is drivingly rotated by the driving torque of the motor M. The cam rotates clockwise so that the bottom portion 22*b* of the cam 22 faces the platen receiver 19 with a clearance d. As a result, the biasing force of the compression spring 21 affects the platen 2 through the platen receiver 19, the platen 2 is elastically contacted with the ends of the stoppers 6, and the gap between the front surface 1*a* of the printing head 1 and the platen 2 is kept at the narrow gap g1 for the printing operation.

FIGS. 5(*a*) and 5(*b*) illustrate a state in which, when the printing paper P has been fed between the printing head 1 and the platen 2 for the printing operation, the gap between the front surface 1*a* of the printing head 1 and the printing surface of the printing paper P is kept at the constant gap g1 irrespective of the thickness of the printing paper P. More specifically, FIG. 5(*a*) shows the case where the printing is effected on a piece of thin paper P1 having a thickness t1, and the platen 2 is kept at the raised position for the printing operation so that the paper P1 is clamped and fastened between the platen 2 and the stoppers 6. Accordingly, the gap between the front surface 1*a* of the printing head 1 and the printing surface of the printing paper P1 is kept at the gap g1. On the other hand, FIG. 5(*b*) shows the case where the printing is effected on a piece of thick paper P2 having a thickness t2, and the platen 2 is kept at the raised position for the printing operation so that the paper P2 is clamped and fastened between the platen 2 and the stoppers 6. Accordingly, also in this case, the gap between the front surface 1*a* of the printing head 1 and the printing surface of the printing paper P2 is kept at the gap g1. The same gap g1 is kept irrespective of the thickness of the paper.

Figure 6:
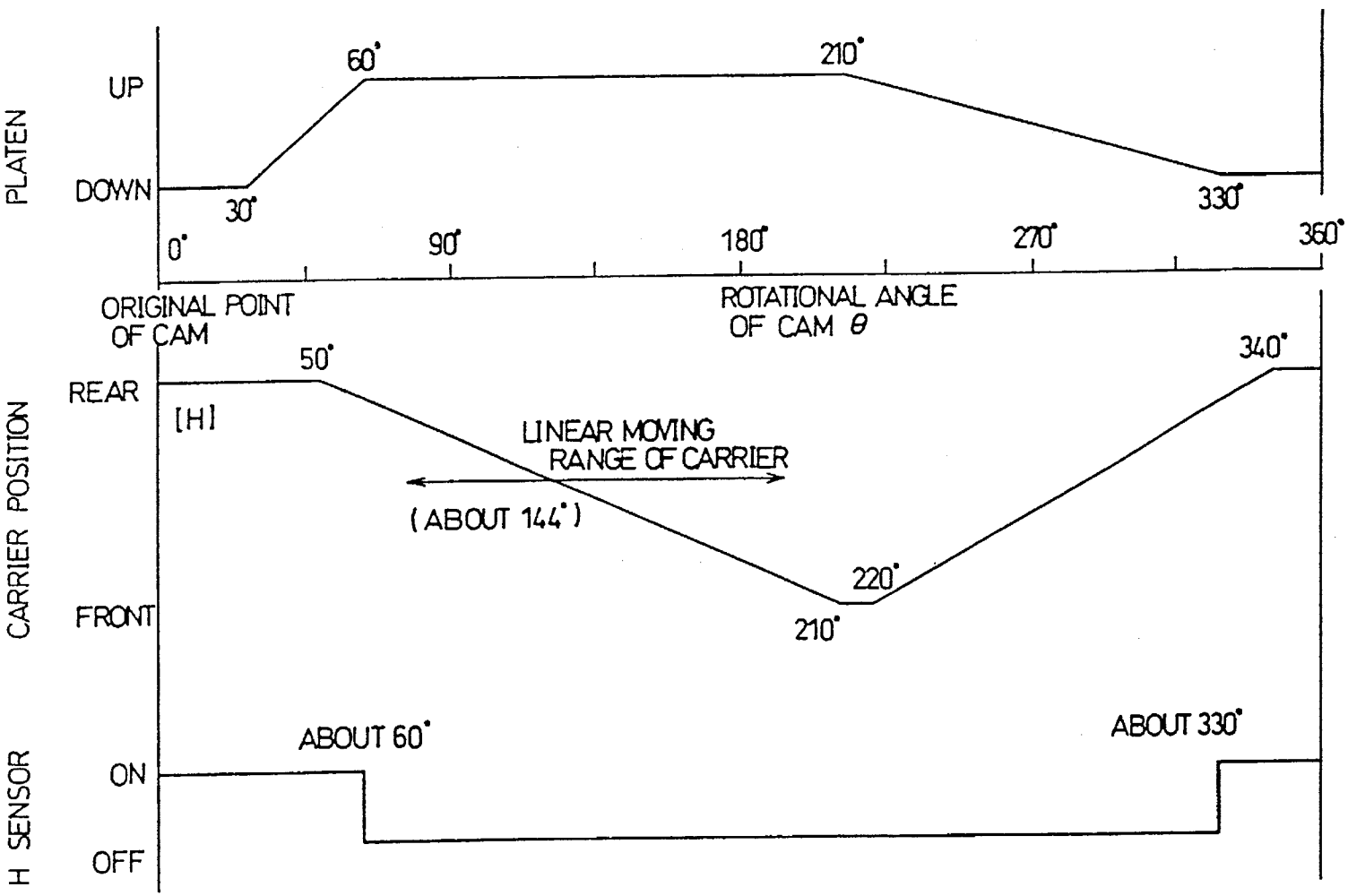
FIG. 6 is a time chart diagram showing a shift of a cam, a shift of a platen, a shift of a carrier and an operation of a home sensor.

FIG. 6 is a diagram showing a time chart representative of the relationship among the shifts of the cylindrical cam 13 and the cam 22 which is the platen moving means, the shift of the platen 2, the shifts of the carrier 7 and hence the printing head 1 and the operation of a home sensor.

The home sensor (hereinafter referred to as an H sensor) for detecting the home position is composed of a detecting piece (not shown) mounted on the carrier 7 and a transmittance type photosensor mounted on one of the stationary frames 20. The H sensor is kept in a dark level and turned on when the carrier 7 is moved close to the home position and is kept in a bright level and turned off when the carrier 7 is separated away from the home position.

First of all, when the H sensor is turned on and the carrier 7 is positioned in the home position, as shown in FIG. 3(*a*), the cam 22 comes into contact with the platen receiver 19 to depress the latter downwardly, and the platen 2 is in the descended position. When the printing paper P is fed and the insertion of the printing paper P is detected by the sensor 30, the motor M is driven to rotate the cylindrical cam 13 and at the same time, the cam 22 also rotates.

The carrier 7 is fed by the rotation of the cylindrical cam 13 but the carrier 7 is not moved up to the rotational angle of 50° due to the shape of the groove 13*a*. During the rotation of the cylindrical cam 13 from 50° to 210°, the carrier 7 is moved in a linear fashion, and the printing operation is effected in the range of about 144° during this period. When the rotational angle of the cylindrical cam 13 becomes 60° and the carrier 7 is separated away from the home position, the H sensor could not detect the carrier 7 and could be turned off.

Also, when the position of the cam portion 22 which is to come into contact with the platen receiver 19 is shifted by the rotation of the cam 22 and the falling edge portion 22*c* has come into contact with the platen receiver 19, the platen receiver 19 starts to gradually move upwardly by the biasing force of the compression spring 21 to thereby gradually raise the platen 2. During the rotational angle of the cam 22 from 30° to 60°, when the falling edge portion 22*c* faces the platen receiver 19 and the rotational angle of the cam 22 reaches 60, a minimum diameter portion of the bottom portion 22*b* faces the platen receiver 19, the clearance d (see FIG. 4(*b*)) is generated between the platen receiver 19 and the bottom portion 22*b*. As a result, the platen 2 is kept at the raised position by the biasing force of the compression spring 21. As described above, in this case, since the carrier 7 starts to move, the printing operation is effected by the printing head 1.

Upon the completion of the printing operation, the rotational angle of the cam 22 reaches 210°, the platen receiver 19 again comes into contact with the bottom portion 22*b* of the cam, and the platen 2 is moved gradually downwardly while compressing the compression spring 21 in accordance with the rotation of the cam 22. Since the slant angle of the bottom portion is gentle, the lowering speed of the platen 2 is also gentle. When the rotational angle of the cam 22 reaches 330, the platen 2 is returned back to the original descended position.

In the range of the rotational angle of the cylindrical cam 13 from 210° to 220°, the feed direction of the carrier 7 is reversed by the groove 13*a*. In the range of the rotational angle of the cylindrical cam 13 from 220° to 340°, the carrier 7 is fed toward the home position, and the rotational angle of the cylindrical cam 13 is at 330°. When the carrier 7 is moved close to the home position, the H sensor detects this and is turned on. Thereafter, the motor M is stopped in a predetermined period of time based upon the detection signal of the H sensor. The carrier 7 is kept under the stop condition and home position. At this time, the rotational angle of the cam 22 and the cylindrical cam 13 is at 360°.

Under the condition that the carrier 7 is positioned at the home position, the platen 2 is kept in the descended position. In this condition, if pieces of printing paper are replaced, the next printing may be effected in the same cycle.

In the raised position of the platen 2, the top surface of the platen 2 is brought into elastic contact with the stoppers 6 through the printing paper P. However, since the slidable portion 19*b* and the guide member 23 are loosely engaged with each other, even if there is some tilts or displacements of the top surface of the platen 2, the platen 2 is uniformly elastically contacted against the stoppers 6 through the printing paper P. Thus, the printing paper P may be clamped and fastened between the platen 2 and the stoppers 6 without fail.

Also, since the beams 18 for supporting the stoppers 6 as well as the guide shaft 4 are fixed to the stationary plates 20, a parallelism of the front faces of the stoppers 6 with the printing direction of the printing head 1 to be transported by the guide shaft 4 may be relatively readily kept in a range in which the stable printing may be effected, for example, at about 0.1 mm in consideration of the assembling precision.

Incidentally, in another embodiment, the platen moving means is not limited to that shown in the drawings, and it is possible to use a solenoid instead of the cam 22, for example. Also, the biasing means is not limited to the compression spring 21 and it is possible to use an elastic member such as a leaf spring.

Also, it is possible to modify the mechanism so that a link, a screw and the like are used instead of the cam 22, and are driven by the motor to move the platen 2, the motor is stopped when the load imposed on the motor exceeds a predetermined value, and the printing paper is clamped and fixed between the platen 2 and the stoppers 6. In this case, the means for driving the link and the like is not limited to the motor and it is possible to use an air cylinder or the like.

Also, it is possible to constitute the stoppers by non-elastic material such as metal and to constitute the surface portion of the platen 2 by elastic material such as rubber.

Also, the invention is not limited to an impact type printing head and it is possible to apply it to the case where any other printing head such as an ink jet type or the like is used.

Also, the invention is not limited to the manual feed of the printing paper, and it is possible to apply the invention to the case where an automatically paper feeding mechanism is provided and the platen 2 is moved corresponding to the automatic paper feed.

As described above, in the printing apparatus according to the present invention, since only the light weight platen is moved close to or away from the printing head, it is possible to hold the mechanical portion, which needs a large weight and a high precision, in the stationary part, thus simplify the structure and increasing the printing speed. Since the stoppers are projected toward the platen beyond the front surface of the printing head, and the printing paper is fixed with its printing surface being depressed against the stoppers irrespective of the thickness of the paper, namely, even if the thick paper or thin paper is used, the gap between the printing head and the printing surface is set to an optimum gap by setting the amount of the projection of the stoppers in consideration of the optimum printing condition, and it is possible to effect a stable printing operation with a high printing quality. Furthermore, because of the simplification of the structure, it is possible to provide the printing apparatus in a low cost. Since the gap between the platen and the printing head is large in the printing stand-by mode, it is easy to insert the printing paper into the apparatus without any fear that the paper would be damaged. Also, since the printing paper is clamped and fastened between the stoppers and the platen in the printing operation, there is no fear that the printing paper would be displaced during the printing operation. Thus, it is possible to ensure a uniform high quality printing. If the guide surface for the printing paper is provided in-the base frame and the platen is shifted to be flush with or somewhat lower than the guide surface, the paper may be inserted without any obstruction by the platen.

I claim:

1. A printing apparatus for guiding a piece of printing paper between a printing head and a platen and effecting the printing, comprising:

a printing head, a carrier, a platen, and a platen receiver; said printing head being carried by said carrier, and said platen being received by said platen receiver;

a base frame, a pair of stationary frame plates mounted to face each other on said base frame for supporting said printing head; and a platen driving means for contacting said platen with said printing head mounted on said base frame;

a guide shaft for guiding said carrier in a printing direction, a carrier driving means for driving said carrier in the printing direction, and stoppers facing said platen around said printing head, said stoppers having ends protruding toward said platen beyond a front surface of said printing head, said stoppers being fixed to said stationary frame plates;

said platen driving means including biasing means for biasing said platen receiver towards said printing head, and platen moving means including cam means disposed between said platen and said platen receiver for moving said platen receiver away from said printing head against a biasing force of said biasing means; and the printing apparatus having a printing stand-by mode, wherein said platen moving means keeps the gap between said platen and said printing heads to a predetermined gap which is larger than the gap in the printing mode, and a printing mode wherein the printing paper is clamped and fastened between said platen and said stoppers by the biasing force of said biasing means.

2. The printing apparatus according to claim 1, characterized in that said cam means is rotated by a driving torque of said carrier driving means.

3. The printing apparatus according to claim 1, characterized in that a guide surface for the printing paper is provided on said base frame, and said platen driving means causes, in the printing stand-by mode, said platen to be flush with said guide surface or to be shifted to a position away from said printing head beyond said guide surface.

* * * * *